United States Patent [19]

von Delden

[11] 4,275,015

[45] Jun. 23, 1981

[54] CARBURETOR WITH MANUAL SELECTABLE FUEL METERING JETS

[76] Inventor: Edmund K. von Delden, 1203 Hickory Ave., Torrance, Calif. 90503

[21] Appl. No.: 133,817

[22] Filed: Mar. 25, 1980

[51] Int. Cl.[3] ..... F02M 7/14

[52] U.S. Cl. ..... 261/23 A; 261/71; 261/40; 261/34 R; 137/625.47

[58] Field of Search ..... 261/23 A, 71, 40, 34 R, 261/68

[56] References Cited

U.S. PATENT DOCUMENTS

| | | | |
|---|---|---|---|
| 1,328,590 | 1/1920 | Royce | 261/71 |
| 2,892,622 | 6/1959 | Goodyear | 261/34 R |
| 3,807,707 | 4/1974 | Johnson | 261/34 R |
| 4,096,213 | 6/1978 | Danger | 261/71 |
| 4,100,663 | 7/1978 | Crum | 261/34 R |

FOREIGN PATENT DOCUMENTS

| | | | |
|---|---|---|---|
| 361860 | 10/1922 | Fed. Rep. of Germany | 261/71 |
| 230043 | 3/1926 | United Kingdom | 261/71 |
| 1322570 | 11/1970 | United Kingdom | 261/71 |

*Primary Examiner*—Tim R. Miles
*Attorney, Agent, or Firm*—Singer & Singer

[57] ABSTRACT

A modular addition to a modular constructed carburetor is disclosed having a manually adjustable control for selecting any of a plurality of fuel jets. A plurality of jets located in the modular addition are individually selectable from a remote location such as the dashboard of a vehicle allowing the driver to select desired fuel jets for the driving conditions encountered thereby maintaining a measure of control over the air/fuel ratio of the mixture flowing from the carburetor.

12 Claims, 5 Drawing Figures

CARBURETOR WITH MANUAL SELECTABLE FUEL METERING JETS

This invention relates generally to a device that allows the driver of a vehicle to remotely select a fuel jet consistent with the driving conditions encountered, and more particularly to a modular addition to a modular constructed carburetor that contains a plurality of fuel jets and controlable valve means for remotely selecting a desired fuel jet.

In order to understand the need for selecting a desired fuel jet size, it is first necessary to understand the functions of a carburetor and how the design parameters of the carburetor are originally derived.

A carburetor is supposed to supply the correct air/fuel mixture to an engine under all operating conditions anticipated. However, carburetors are not self-compensating for variations in the physical properties of air and/or fuel resulting from temperature, pressure or humidity changes.

The carburetor is initially sized for a particular internal combustion engine by considering piston displacement and the atmospheric conditions under which the greatest amount of oxygen will be supplied per unit volume of air passing through the carburetor to be mixed with fuel and supplied to the engine.

It must be remembered that running an engine with excess fuel is wasteful but not otherwise harmful to the engine, whereas excessive leaning of the air/fuel mixture can be harmful to the engine and cause permanent damage to the pistons, valves and exhaust system as a result of backfiring or excessive combustion temperatures.

First, for a given size engine considering rpm and power output, the engineer selects a Venturi size that will create the required air flow velocity to produce the desired air/fuel mixture quality to be delivered from the carburetor to the engine.

Second, the engineer selects a fuel jet size to meter fuel in correct proportion to the highest oxygen content air to be ingested by the engine in its operating environment. The highest oxygen content of air occurs at lowest temperature, lowest relative humidity and highest atmospheric pressure. This is the worst case (leanest) condition and any variation of temperature, pressure or humidity will shift the air/fuel mixture toward a fuel rich condition, thereby guaranteeing the engine will not operate overly leaned. That is, operating the engine at a higher altitude than sea level where the atmospheric pressure is lower or at a higher ambient temperature or at a higher relative humidity will result in a reduction in the amount of oxygen available thereby causing the air/fuel mixture to run in a rich condition. This procedure results in a fail-safe operation which prevents a condition to exist that can cause a lean mixture to predominate and hence damage the engine.

Unfortunately, this condition, although a fail-safe, usually results in the engine running with a rich mixture of fuel and air during nominal conditions that is wasteful of gasoline. In addition, driving a vehicle to higher altitude or to a desert region causes the engine to run even richer because the carburetor is not selfcompensating for these variables.

Partial solutions to these problems are provided by the carburetor manufacturers by providing a range of fuel jets that tailor make the carburetor to the driving condition expected to be encountered by the driver of the vehicle. For example, a car sold for use on the plains states to be driven at sea level would contain the largest fuel jet whereas a car intended for use at the 5,000 to 7,000 foot elevation level will have a smaller fuel jet, whereas a car intended for use in the high Rockies at the 10,000 to 11,000 foot level would have a still smaller fuel jet.

These solutions are at best not permanent solutions since present-day carburetors must be dismantled and taken apart by a mechanic in order to remove and install different fuel jets. In addition, it must be remembered that driving a car designed for sea level use to the high mountains can result in rich mixture fouling of spark plugs, starting problems, and a waste of fuel, whereas driving a car with a high altitude fuel jet to a low sea level environment results in a leaning condition which can cause permanent damage to the engine as mentioned above.

In this invention there is disclosed a modular additive device for use with present-day carburetors that contains a plurality of jets and a valve selector remotely controllable from the dashboard that allows the driver to select a desired fuel jet for the driving conditions encountered and without the necessity of removing or reassembling the carburetor.

The modular concept is particularly adaptable to a modular carburetor known as a Holley Modular Carburetor manufactured by the Colt Industries Operating Corporation, such as Model 2300, representing 2 barrel carburetors, and Modles 4150, 4160, 4165, 4175 and 4500, representing 4 barrel carburetors.

The fuel efficiencies to be derived are most apparent in connection with trucks, vans and recreational vehicles and as a result a modular addition is adaptable for use with the Holley Modular Carburetor Model 4160.

The Model 4160 Modular Carburetor is basically a 4 barrel carburetor comprising a central portion containing the carburetor barrel assembly. A fuel flow assembly and a metering plate is located on one side for controlling two primary barrels of the carburetor whereas a separate fuel float is attached to the opposite side of the carburetor for feeding fuel to the two secondary barrels of the carburetor.

The metering plate contains two fuel jets, one for each of the two primary barrels, and the necessary metering controls for controlling the idling condition and the boost control for supplying fuel under passing conditions.

In the practice of the present invention the two fuel jets are removed from the metering plate and a fuel jet selector plate is interposed between the carburetor metering plate and the carburetor fuel float assembly.

In the preferred embodiment the fuel jet selector plate contains three pairs of fuel jets, each located in a vertical chamber. Each vertical chamber contains a sealing cap on the end portion that is easily removable from the outside of the fuel jet selector plate, thereby allowing the user to change the size of the fuel jets if he desires.

The bottommost portion of each pair of the vertical jet chambers are connected together and directed to two ports located on one side of the jet fuel selector plate facing the carburetor metering plate. The ports are located in direct alignment with the fuel jet openings on the carburetor metering plate and with the application of suitable O-ring seals provide a means for accepting fuel from the jet selector plate.

Centrally located on the fuel jet selector plate is a separate vertical valve chamber having a port communicating with the fuel float assembly, thereby allowing a supply of fuel from the carburetor float assembly to be fed into the vertical valve chamber. A plurality of separate horizontal chambers, one for each vertical jet chamber, is connected to the vertical valve chamber.

A remotely controllable valve is located within the vertical valve chamber and selectively connects each pair of vertical jet chambers to the common intake port from the carburetor float chamber for feeding metered fuel to the Venturi.

The fuel jet selector plate is strictly an addition and performs the function only of allowing the driver to select fuel jets consistent with the driving conditions being encountered at that moment. The functions of the carburetor metering plate are not disturbed or changed.

Further objects and advantages will become more apparent by referring now to the accompanying drawings wherein.

Figure 1:
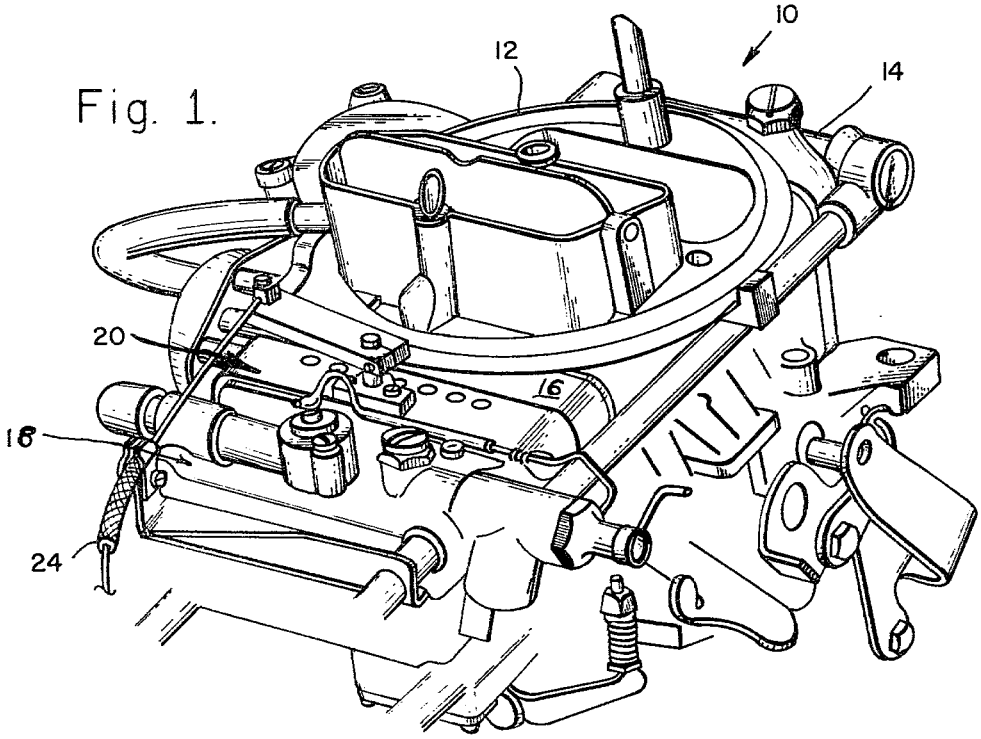
FIG. 1 illustrates a typical four barrel modular carburetor containing the fuel jet selector plate.

Referring now to FIG. 1, there is shown a typical modular carburetor 10 of the type manufactured by Holley and known as Model 4360 and containing the fuel jet selector plate.

The carburetor 10 is a four barrel carburetor in which the central portion 12 contains the barrel assembly and the Venturi assemblies. Located on one side of the barrel assembly 12 is a fuel float assembly 14 that is part of the secondary circuit and used to supply additional air/fuel mixture for passing in acceleration conditions. This portion of the carburetor is not concerned with jet selection or metering of fuel but is used only for the secondary function where extra power is requested or demanded.

The other side of the barrel assembly 12 contains a carburetor metering plate 16 that contains the idle adjustments and the enrichment circuits and necessary metering circuits for controlling the operation of the carburetor. Normally the metering plate 16 would contain two fuel jets for metering the fuel in the two controllable barrels associated with the barrel assembly 12. In the practice of the present invention, the fuel metering jets normally located in the metering plate 16 are removed.

In the normal configuration, a second fuel float assembly 18 is connected to the other side of the metering plate 16, however, in the practice of the present invention a fuel jet selector plate 20 is interposed between the metering plate 16 and the fuel float assembly 18.

There are minor external changes made to the modular carburetor 12 to account for the extra thickness of the fuel jet selector plate 20 between the fuel float assembly 18 and the metering plate 16. The idle control and the enrichment circuit contained in the carburetor metering plate 16 are not affected and are still performed by the metering plate. A longer fuel transfer tube and reshaped accelerator pump arm are required to account for the added thickness of the fuel jet selector plate so as not to disturb the normal operation of these functions.

certain obvious changes necessary to the installation include elongated mounting studs to accept the added thickness of the fuel jet selector plate 20. In addition, the fuel bypass from the second fuel float assembly 18 to the first fuel float assembly 14 must be extended due to the thickness of the fuel jet selector plate 20.

Figure 2:
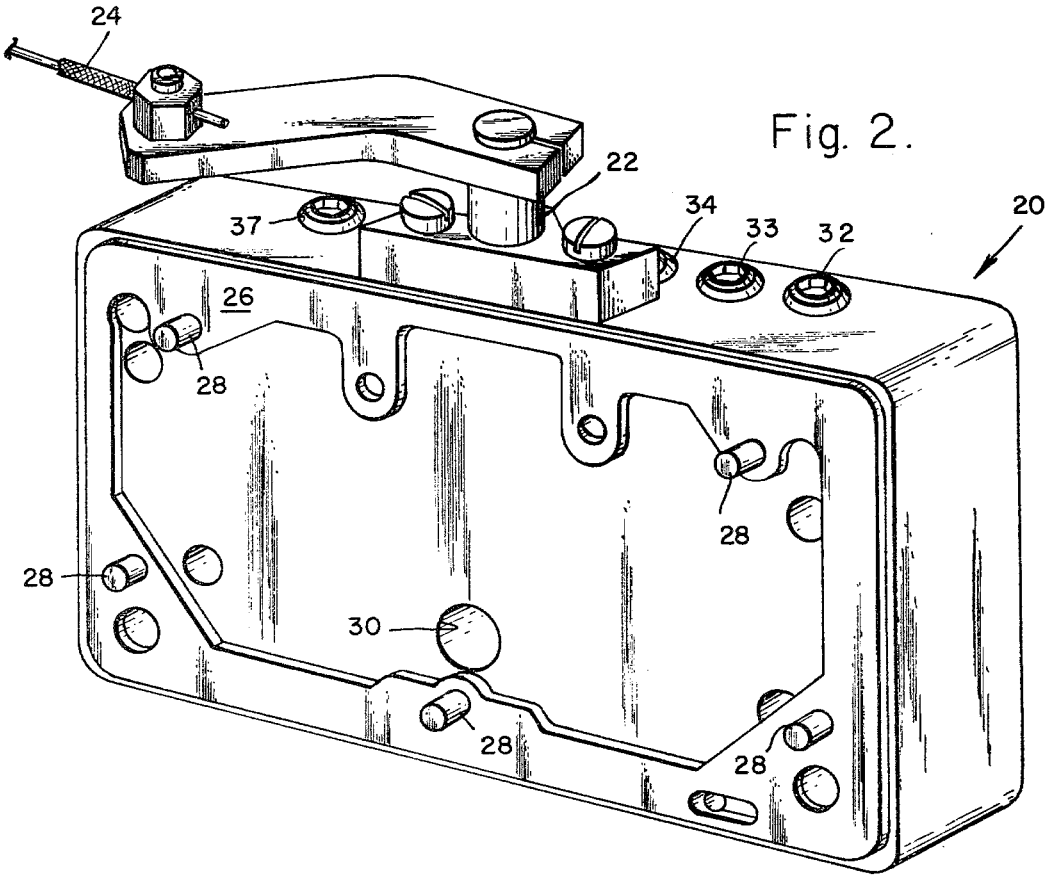
FIG. 2 is a perspective view showing the fuel jet selector plate.

The fuel jet selector plate 20, also illustrated in FIG. 2, contains a centrally located valve 22 that is remotely controlled from the cabin of the vehicle by a suitable push-pull cable arrangement 24.

In the preferred embodiment the fuel jet selector plate 20 is constructed in the form of a rectangle and has the same approximate shape and size as the carburetor metering plate 16.

When installed, the fuel jet selector plate is caused to abut against a suitable gasket interposed between the fuel jet selector plate and the carbutetor metering plate 16. In a similar fashion a gasket 26 is interposed between the fuel jet selector plate 20 and the fuel float assembly 18. On the side of the fuel jet selector plate 20 facing the fuel float assembly 18 are a plurality of alignment pins 28 to ensure proper alignment between the mating surfaces.

A port 30 is also located on the face of the fuel jet selector plate 20 facing the fuel float assembly 18 and which is adapted to communicate with the chamber holding the valve 22. The internal arrangement comprising the fuel jet selector plate 20 is more fully described in connection with FIG. 4.

Located on the uppermost surface of the fuel jet selector plate 20 are a plurality of sealing caps 32, 33, 34, 35, 36 and 37. Caps 35 and 36 are more easily identifiable in FIG. 4. Caps 32 through 37 cover and seal the chambers holding the individual fuel jets, there being one chamber and one sealing cap for each fuel jet used. In the preferred embodiment there are three sets of fuel jets thereby giving the operator of the vehicle a choice of three separate selections for metering the fuel to the two controllable barrels of the carburetor.

Figure 3:
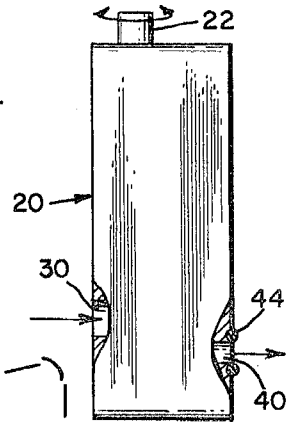
FIG. 3 is a side view of the fuel jet selector plate showing the intake ports facing the fuel float assembly and the exhaust ports facing the metering plate.

Referring now to FIG. 3, there is shown a side view of the fuel jet selector plate 20 more fully illustrating the valve assembly 22 and the port 30 facing the fuel float assembly.

Located on the other side of the fuel jet selector plate facing the carburetor metering plate 16 are two ports 40 and 42, one behind the other, that are in alignment with two openings in the carburetor metering plate 16 for accepting the metering fuel from the fuel jet selector plate. A pair of O-rings 44 and 46 are located around ports 40 and 42, respectively, and are held in place by a recess around each of the ports 40 and 42.

Figure 4:
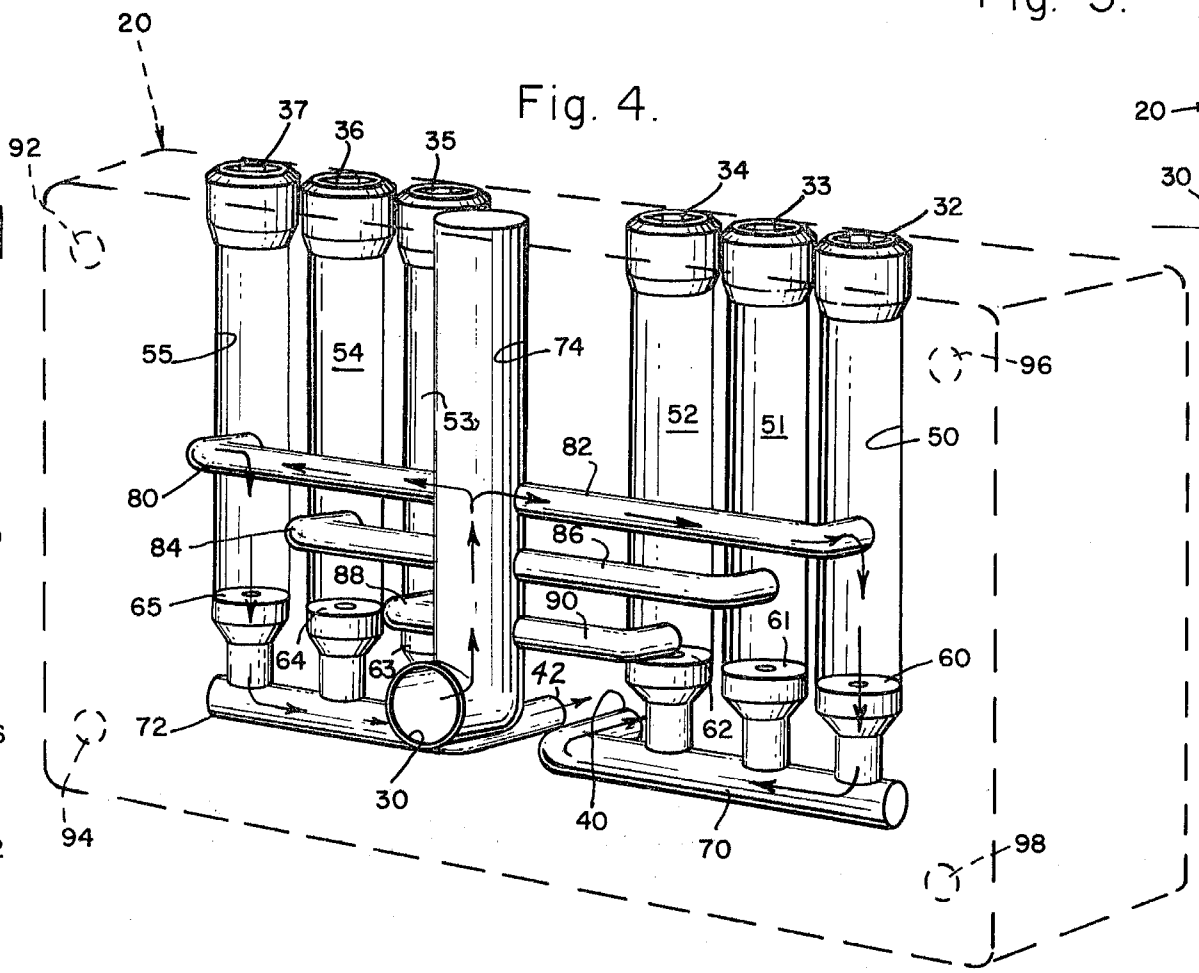
FIG. 4 is a cutaway drawing of the fuel jet selector plate illustrating the internal chambers.

Referring now to FIG. 4, there is shown a cutaway drawing of the fuel jet selector plate 20 more fully illustrating the individual chambers for directing the flow of the metered fuel and the chambers for holding the individual fuel jets.

In the preferred embodiment being illustrated, the fuel jet selector plate 20 is adapted to hold three pairs of fuel jets thereby giving the vehicle operator a choice of jets for sea level operation, for intermediate altitude elevation such as 5,000 feet, and jets for high altitude elevation on the order of 10,000 feet. Practical considerations limit the number of jets to three pairs, however, the fuel jet selector plate 20 may be constructed of a larger size thereby allowing the placement of additional jets should that be a requirement. The design illustrated was sized to keep the fuel jet selector plate 20 the same approximate size as the carburetor metering plate 16 and hence the limitation on the overall dimensions are determined by outside considerations and do not limit the scope of the inventive concept. It is also envisioned that the fuel jet selector plate 20 may only require two sets of metering jets as opposed to the three sets illustrated. The number of jets are therefore a determination of the needs of the user and actually any number is within the scope of the invention.

The fuel jet selector plate 20 contains six vertical chambers 50, 51, 52, 53, 54 and 55. The sealable caps 32 through 37 are removable and cover each of the chambers respectively. A fuel jet 60, 61, 62, 63, 64 and 65 are located in the bottommost portion of chambers 50 through 55, respectively.

Each of the sealing caps 32 through 37 are removable to allow replacement of the individual fuel jets 60 through 65. The actual selection of jets can therefore be made by the operator of the vehicle without dismantling the carburetor since the caps 32 through 37 are accessible from the uppermost portion of the fuel jet selector plate 20.

In practice, jets 60 and 65 located in chambers 50 and 55 are identical and may for example be selected for sea level conditions. Jets 61 and 64 located in chambers 51 and 54, respectively, are identical and may represent jets needed for 5,000 foot altitude driving. Lastly, jets 62 and 63 located in chambers 52 and 53, respectively, are identical and may represent driving conditions of high altitude of 10,000 feet. The actual selection of jets will be determined by the needs of the driver who now has three selectable conditions from which to choose.

The bottommost portion of chambers 50, 51 and 52 are joined together in a horizontal chamber 70 that communicates with port 40 which faces the carburetor metering plate 16. Similarly, the bottommost portion of chambers 53, 54 and 55 are joined together in a horizontal chamber 72 which communicates with port 42 facing the carburetor metering plate 16. As previously described, ports 40 and 42 are each located in a sealing relationship with the metering jet openings provided by the carburetor metering plate 16 for distributing the metered fuel.

Centrally located in the fuel jet selector plate 20 is a separate vertical valve chamber 74 which is accessible from the topmost portion of the metering plate to accept a valve assembly 76, more fully illustrated in connection with FIG. 5.

The lowermost portion of the valve chamber 74 communicates with port 30 which faces the carburetor fuel float assembly 18 which supplies the fuel for distribution by the valve assembly 76.

Fuel jet chambers 50 and 55 are each separately connected to the valve chamber 74 by aligned horizontal chambers 80 and 82. In a similar fashion, the fuel chambers 51 and 54 are interconnected with the valve chamber 74 by aligned horizontal chambers 84 and 86. Similarly, fuel jet chambers 52 and 53 are interconnected with the valve chamber 74 by aligned horizontal chambers 88 and 90.

Located on the four corners of the fuel jet selector plate are four through openings 92, 94, 96 and 98, located to accept the four holddown rods located in the barrel assembly 12 illustrated in FIG. 1 and which form the holddown means for the carburetor metering plate 16, the fuel jet selector plate 20, and the fuel float assembly 18.

Figure 5:
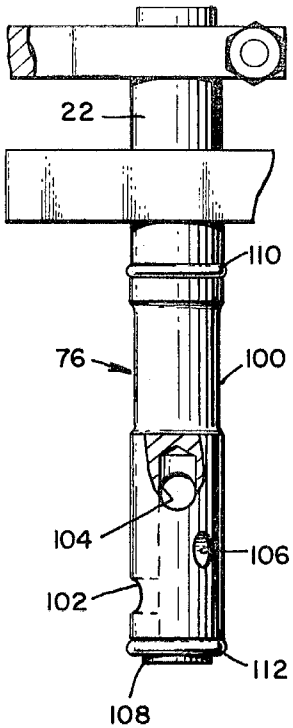
FIG. 5 illustrates the valve assembly that fits within the fuel jet selector plate illustrated in FIGS. 2 and 4.

Referring now to FIG. 5, there is shown the valve assembly 76 comprising a valve cylinder 100 sized to fit into the valve chamber 74 in the fuel jet selector plate 20 illustrated in FIG. 4. The valve cylinder 100 contains three through openings 102, 104 and 106. Each of these through openings are on a diameter and are located in the valve cylinder 100 so as to be aligned with the horizontal opposed chambers 88 and 90 and 84 and 86 and 80 and 82, respectively.

The internal portion of the valve cylinder 100 contains a hollow cylindrical opening 108 which extends to a point just above through opening 104. Conventional O-rings 110 and 112 are located on the uppermost and lowermost portion of the valve cylinder 100 to effectively seal the valve assembly 76 when located within the valve chamber 74.

In operation, rotating the valve 22 will align the through opening 104 with the horizontal opposed chambers 80 and 82 illustrated in FIG. 4. This action allows fuel from the carburetor float assembly 14 to flow through port 30 through opening 108 in the valve assembly 76 and out through opening 104 into chambers 80 and 82. The fuel from chambers 80 and 82 will pass into fuel jet chambers 55 and 50, respectively, and down through fuel jets 65 and 60 and into horizontal chambers 72 and 70, respectively, and out ports 42 and 40 which are in communication with the carburetor metering plate 16.

Rotating the valve 22 further will align through opening 106 with horizontal chambers 84 and 86 and disconnect the through opening previously supplied for horizontal chambers 80 and 82. In this position fuel from the fuel float assembly 14 will pass through port 30 through opening 108 in the valve assembly 76 and out through opening 106 which is now aligned with horizontally opposed chambers 84 and 86. In a similar fashion as previously described, fuel will flow into fuel jet chambers 54 and 51, respectively, and through fuel jets 64 and 61 into horizontal chambers 72 and 70 and out ports 42 and 40, respectively, which are in communication with the carburetor metering plate.

In a similar fashion, through opening 102 located on the valve assembly 76 will align horizontal and oppose chambers 88 and 90 to allow metered fuel to pass through fuel jets 63 and 62, respectively, into horizontal chambers 72 and 70 and out ports 42 and 40.

A review of the fuel jet selector plate 20 will show that the driver of the vehicle now has at his disposal a measure of control which allows him to select from a plurality of fuel jets depending only upon his requirements as a driver. Once the fuel jet selector plate 20 is located in place and aligned, the individual fuel jets can be easily removed without disassembling the carburetor by simply removing any of the caps 32 through 37 illustrated in FIG. 4.

The fuel jet selector plate 20 does not change the operation of the basic carburetor and hence all other controls such as metering controls and enrichment controls are not affected or influenced by the addition of the fuel jet selector plate.

The individual carburetor metering plate 16 contains openings and vent holes communicating with the carburetor float assembly 18 that are necessary for the idle metering action and the enrichment circuit. It will be apparent to those skilled in the art to provide additional passageways through the fuel jet selector plate 20 to accommodate these openings or vent holes so as not to interfere with the metering and enrichment action. These additional passageways are obvious upon inspection and do not form part of the present invention.

The basic carburetor is easily replaced to its original condition by simply removing the fuel jet selector plate and replacing the fuel float assembly 18 against the carburetor metering plate 16. It will be necessary of course to now insert a pair of fuel jets in the carburetor metering plate 16 before reassembling the carburetor.

In the preferred embodiment the rotor portion of the valve assembly will be provided with a suitable detent to enable the driver to very quickly locate a desired position for selecting a pair of fuel jets. Such devices are within the skill of the art and it is obvious that any kind of detent may be used.

I claim:

1. A selectable fuel jet carburetor comprising:

a modular constructed carburetor having a centrally located barrel assembly and a metering plate located adjacent the barrel assembly on one side and a fuel float assembly adapted to be attached to the opposite side of the metering plate, a fuel jet selector plate containing a plurality of selectable fuel jets interposed between the fuel float assembly and the metering plate, and a remotely controlled valve located in said fuel jet selector plate for selecting a desired fuel jet to feed the carburetor metering plate.

2. In a modular constructed carburetor having a centrally located barrel assembly, a metering plate having one side attached to the barrel assembly and a fuel float assembly adapted to be attached to the opposite side of the metering plate the improvement comprising:

a fuel jet selector plate containing a plurality of selectable fuel jets interposed between the carburetor fuel float assembly and the carburetor metering plate and providing passageways from the fuel float assembly through the selected jets to the metering plate, and a remotely controlled valve located in said fuel jet selector plate for selecting a desired fuel jet to feed the carburetor metering plate.

3. A fuel jet selector plate according to claim 2 which includes a multiple pair of fuel jets and in which said valve selects a desired pair of said fuel jets.

4. A fuel jet selector plate according to claim 3 which includes three different pairs of fuel jets each pair being selectable by said valve.

5. A fuel jet selector plate according to claim 2 in which said fuel jets are each located in a vertical chamber.

6. A fuel jet selector plate according to claim 5 which includes a removable sealing cap over each vertical chamber whereby each of said fuel jets is removable without dismantling the carburetor.

7. A fuel jet selector plate according to claim 2 which includes a first port communicating with the carburetor fuel float assembly at one end and with said remotely controlled valve at the other end.

8. A fuel jet selector plate according to claim 2 in which said remotely controlled valve contains a plurality of passages equal to the number of jets to be selected and is sealably engaged in a vertical opening for rotational movement.

9. In combination with a modulator constructed carburetor the improvement comprising:

a fuel selector plate adapted to be interposed between a carburetor metering plate and a carburetor fuel float assembly, said fuel selector plate comprising a plurality of fuel jets each located in a separate vertical jet chamber, the bottommost portion of each of the vertical jet chambers communicating with the fuel intake port of the carburetor metering plate, a separate vertical valve chamber communicating with the carburetor fuel float assembly and adapted to receive a rotatable valve, a plurality of separate horizontal chambers each interconnecting the upper portion of each vertical jet chamber with the vertical valve assembly, and a remotely controllable valve located in said valve chamber for selecting a desired fuel jet chamber in the path from the carburetor fuel float assembly to the carburetor metering plate.

10. A combination according to claim 9 in which said valve contains a plurality of passages equal to the number of jets to be selected and in which said passages are adapted to be aligned sequentially with said horizontal chambers.

11. A combination according to claim 9 in which said fuel metering plate is mounted on the same stud assemblies holding the carburetor metering plate and the carburetor fuel float assembly.

12. A combination according to claim 9 which includes at least two pairs of different fuel jets in separate vertical jet chambers, and in which the bottommost portion of each pair of vertical jet chambers communicates with the fuel intake ports of the carburetor metering plate.

* * * * *